US007874349B2

(12) United States Patent
Duong et al.

(10) Patent No.: US 7,874,349 B2
(45) Date of Patent: Jan. 25, 2011

(54) HEAT EXCHANGER TANK

(75) Inventors: David Thanh Duong, Oxford, MI (US); Jonathan Adam Raver, Northville, MI (US); Wen Fei Yu, Ann Arbor, MI (US); James Melvin Kirchoff, Ypsilanti, MI (US); Chris Allen Vsetula, Brighton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 1217 days.

(21) Appl. No.: 11/376,880

(22) Filed: Mar. 16, 2006

(65) Prior Publication Data

US 2007/0215334 A1 Sep. 20, 2007

(51) Int. Cl.
*F28F 9/02* (2006.01)

(52) U.S. Cl. ..... 165/173; 165/175

(58) Field of Classification Search ..... 165/172, 165/173, 174, 175, 176; *F28F 9/02*
See application file for complete search history.

(56) References Cited

U.S. PATENT DOCUMENTS

| | | | |
|---|---|---|---|
| 3,231,017 | A | 1/1966 | Henderson |
| 4,207,662 | A | 6/1980 | Takenaka |
| 5,052,475 | A | 10/1991 | Grundy |
| 5,069,275 | A | 12/1991 | Suzuki et al. |
| 5,107,926 | A | 4/1992 | Calleson |
| 5,125,454 | A | 6/1992 | Creamer et al. |
| 5,183,103 | A | 2/1993 | Tokutake |
| 5,205,349 | A | 4/1993 | Nagao et al. |
| 5,205,354 | A | 4/1993 | Lesage |
| 5,295,302 | A | 3/1994 | Takai et al. |
| 5,441,100 | A | 8/1995 | Ueda et al. |
| 5,450,896 | A | 9/1995 | Bertva et al. |
| 5,538,079 | A | 7/1996 | Pawlick |
| 5,667,004 | A | 9/1997 | Kroetsch |
| 5,845,705 | A | 12/1998 | Vinh et al. |
| 5,868,196 | A | 2/1999 | Tanaka |
| 6,179,050 | B1 | 1/2001 | Dey et al. |
| 6,250,381 | B1 | 6/2001 | Nishishita |
| 6,293,334 | B1 | 9/2001 | Ghiani |
| 6,318,450 | B1 | 11/2001 | Acre |
| 6,446,711 | B1 | 9/2002 | DeGroot et al. |
| 6,510,891 | B2 | 1/2003 | Anderson et al. |
| 6,523,606 | B1 | 2/2003 | Dienhart et al. |
| 6,527,044 | B2 | 3/2003 | Mangold |
| 6,546,999 | B1 | 4/2003 | Dienhart et al. |
| 6,672,376 | B2 | 1/2004 | Shembekar et al. |

(Continued)

FOREIGN PATENT DOCUMENTS

| | | | |
|---|---|---|---|
| DE | 196 01 276 | A1 | 7/1997 |

(Continued)

*Primary Examiner*—Ljiljana (Lil) V Ciric
(74) *Attorney, Agent, or Firm*—Fraser Clemens Martin & Miller LLC; J. Douglas Miller

(57) ABSTRACT

A heat exchanger includes a pair of tanks, each of the tanks having a pair of baffles sealingly engaged to a center wall, a pair of sidewalls, and a cover to form a fluid tight seal therebetween and provide a closure to the tank, wherein each of the sidewalls includes a portion of at least one of a pin and bracket for mounting the heat exchanger.

20 Claims, 5 Drawing Sheets

U.S. PATENT DOCUMENTS

| | | | |
|---|---|---|---|
| 6,675,883 | B1 | 1/2004 | De Keuster et al. |
| 6,705,387 | B2 | 3/2004 | Kokubunji et al. |
| 6,871,774 | B2 | 3/2005 | DeSalve |
| 6,904,958 | B2 | 6/2005 | Ozaki et al. |
| 6,971,438 | B2 | 12/2005 | Oki et al. |
| 2001/0017201 | A1 | 8/2001 | Avequin et al. |
| 2002/0038700 | A1 | 4/2002 | Gille |
| 2003/0075305 | A1 | 4/2003 | Sanada et al. |
| 2003/0150603 | A1 | 8/2003 | Auchter et al. |
| 2005/0039900 | A1 | 2/2005 | Yu |

FOREIGN PATENT DOCUMENTS

| | | | | |
|---|---|---|---|---|
| DE | 695 11 835 | T2 | | 12/1999 |
| DE | 601 02 855 | T2 | | 4/2005 |
| EP | 0 450 619 | A1 | * | 10/1991 |
| EP | 0 480 628 | A1 | * | 10/1991 |
| EP | 0 584 994 | A1 | * | 8/1993 |
| WO | WO 93/04334 | | * | 3/1993 |

* cited by examiner

HEAT EXCHANGER TANK

FIELD OF THE INVENTION

The invention relates to a heat exchanger and more particularly to a heat exchanger having a tank wherein a main body of the tank is produced from a planar sheet which is folded to form a pair of spaced apart sidewalls and a center wall joining the sidewalls.

BACKGROUND OF THE INVENTION

An air-cooled fin-type heat exchanger for a vehicle is well known in the art. A common use for the heat exchanger is reducing the temperature of various working fluids such as engine coolant, engine lubricating oil, air conditioning refrigerant, and automatic transmission fluid, for example. The heat exchanger typically includes a plurality of spaced apart fluid conduits or tubes connected between a pair of tanks. One of the tanks includes an inlet of the heat exchanger and the other tank includes an outlet of the heat exchanger. A plurality of fins is interposed between adjacent conduits. Air is caused to flow across the fins by a cooling fan or a motion of the vehicle. As the air flows across the fins, heat in the fluid flowing in the tubes is conducted through the walls of the tubes, through the fins and transferred or "exchanged" into the airflow. The fluid flowing from the outlet of the heat exchanger has a lower temperature than the fluid flowing into the inlet of the heat exchanger.

The heat exchanger for the vehicle is typically constructed with aluminum fins, tubes, headers and side supports to minimize a weight thereof. The tanks are generally made of plastic and are sealed to the aluminum core assembly using a rubber gasket. Several problems exist with these heat exchangers, including difficulties with post consumer recycling, a high amount of material usage, and the creation of gasket warranty issues.

More recently, all aluminum heat exchangers have been developed in an attempt to overcome these problems. However, problems also exist with all aluminum heat exchangers such as a heightened complexity of the manufacture and assembly processes, for example.

It would be desirable to produce a heat exchanger for a vehicle wherein a complexity of manufacture and assembly is minimized.

SUMMARY OF THE INVENTION

Harmonious with the present invention, a heat exchanger wherein a complexity of manufacture and assembly is minimized has surprisingly been discovered.

In one embodiment, a tank for a heat exchanger comprising: a center wall having a plurality of tube openings formed therein, each of the tube openings adapted to communicate with a heat exchanger tube; a first sidewall extending laterally outwardly from the center wall; a second sidewall extending laterally outwardly from the center wall and substantially parallel to and spaced apart from the first sidewall, wherein the center wall, the first sidewall, and the second sidewall are integrally formed; an elongate cover having a first end, a second end, a first edge and a second edge, the first edge joined to the first sidewall and the second edge joined to the second sidewall, a first baffle sealingly engaging the center wall, the first sidewall, the second sidewall, and the first end of the cover; and a second baffle sealingly engaging the center wall, the first sidewall, the second sidewall, and the second end of the cover.

In another embodiment, a heat exchanger comprising: a first tank having an inlet and a plurality of tube openings formed therein, the inlet adapted to be in communication with a source of coolant; a second tank having a plurality of tube openings and an outlet formed therein, the outlet adapted to be in communication with the source of coolant, wherein at least one of the first tank and the second tank further comprises a cover having a first end and a spaced apart second end, a center wall, a first sidewall, a second sidewall, a first baffle sealingly engaging the center wall, the first sidewall, the second sidewall, and the first end of the cover, and a second baffle sealingly engaging the center wall, the first sidewall, the second sidewall, and the second end of the cover, the center wall, the first sidewall, and the second sidewall integrally formed, wherein the cover is joined to the first sidewall and the second sidewall; and a plurality of tubes having a first end and a second end, the first end of each of the tubes is in fluid communication with one of the tube openings of the first tank and the second end of each of the tubes is in fluid communication with one of the tube openings of the second tank.

In yet another embodiment, a method of making a tank for a heat exchanger is disclosed, comprising the steps of: providing a substantially planar sheet having a plurality of tube opening formed therein; bending the sheet at a first bend line and a second bend line to form a center wall, a first sidewall, and a second sidewall; providing a first baffle and a second baffle; positioning the first baffle between the first sidewall and the second sidewall to form a fluid-tight seal between the first baffle and the first sidewall, the second sidewall, and the center wall; positioning the second baffle between the first sidewall and the second sidewall to form a fluid-tight seal between the second baffle and the first sidewall, the second sidewall, and the center wall; providing a cover having a first edge and a second edge; positioning the first edge of the cover on the first sidewall over the first baffle and the second baffle and the second edge of the cover on the second sidewall over the first baffle and the second baffle; and joining the cover to the first sidewall, the second sidewall, the first baffle, and the second baffle to create a fluid tight seal therebetween.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
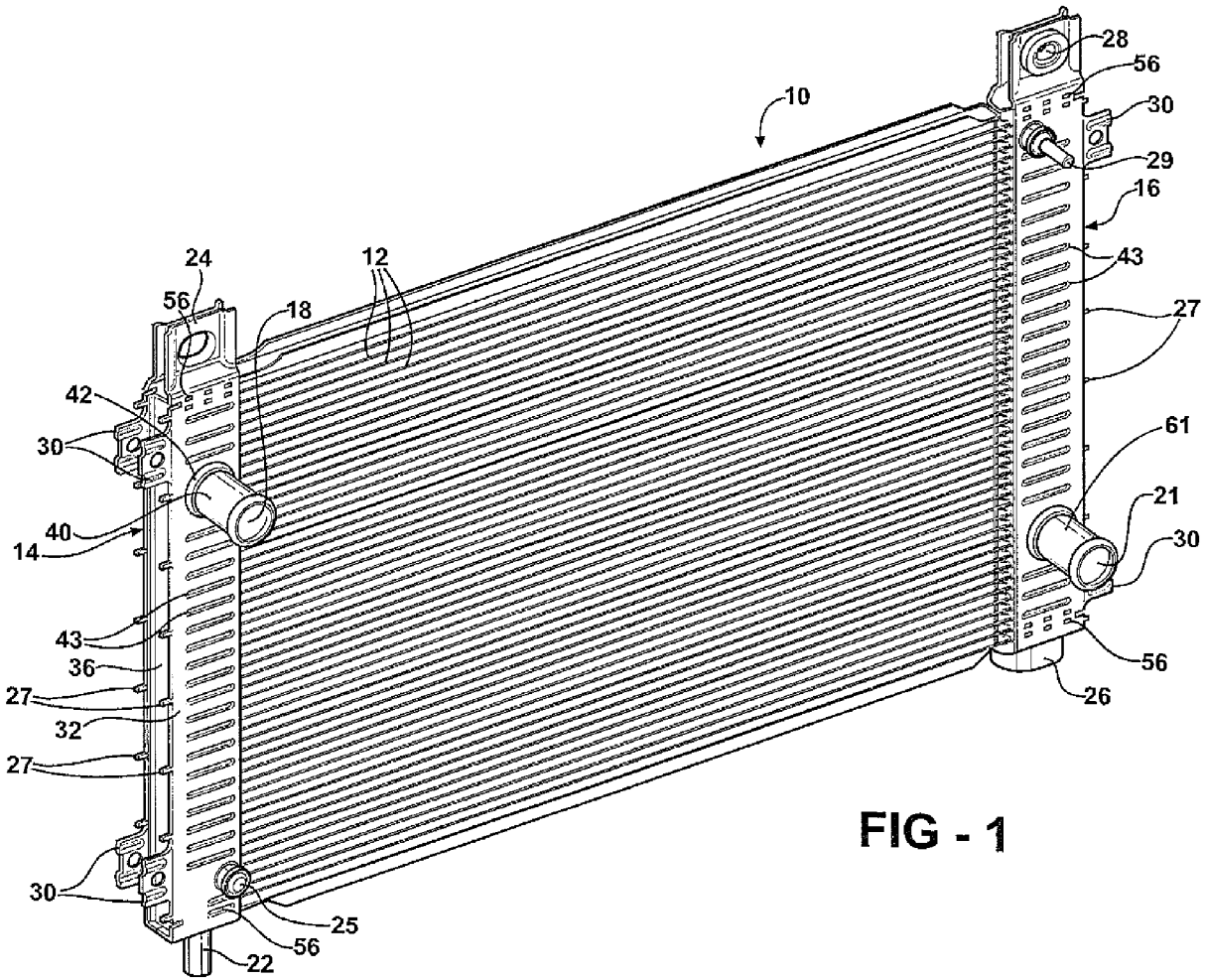
FIG. 1 is a perspective view of a heat exchanger in accordance with an embodiment the invention.
Figure 2:
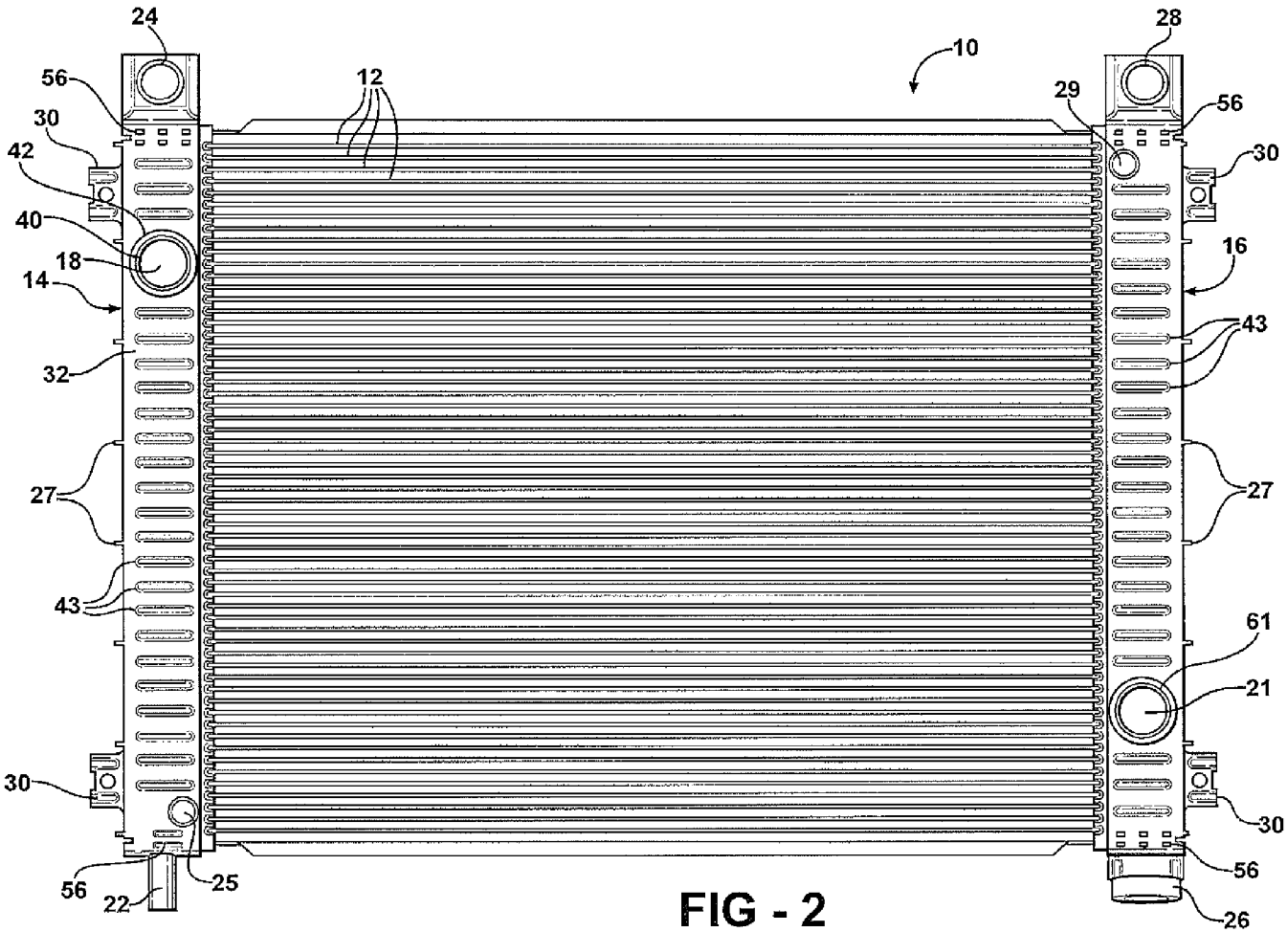
FIG. 2 is a front elevational view of the heat exchanger illustrated in FIG. 1.

FIGS. 1 and 2 illustrate a heat exchanger 10 according to an embodiment of the present invention. The heat exchanger 10 includes of a series of parallel tubes 12. Each of the tubes 12 is connected at a first end to a first tank 14, and at a second end to a second tank 16. The tube 12 can be any conventional tube, as is well known in the art. The first tank 14 and the second tank 16 are substantially similar. Therefore, only the first tank 14 is detailed in the drawings.

Figure 5:
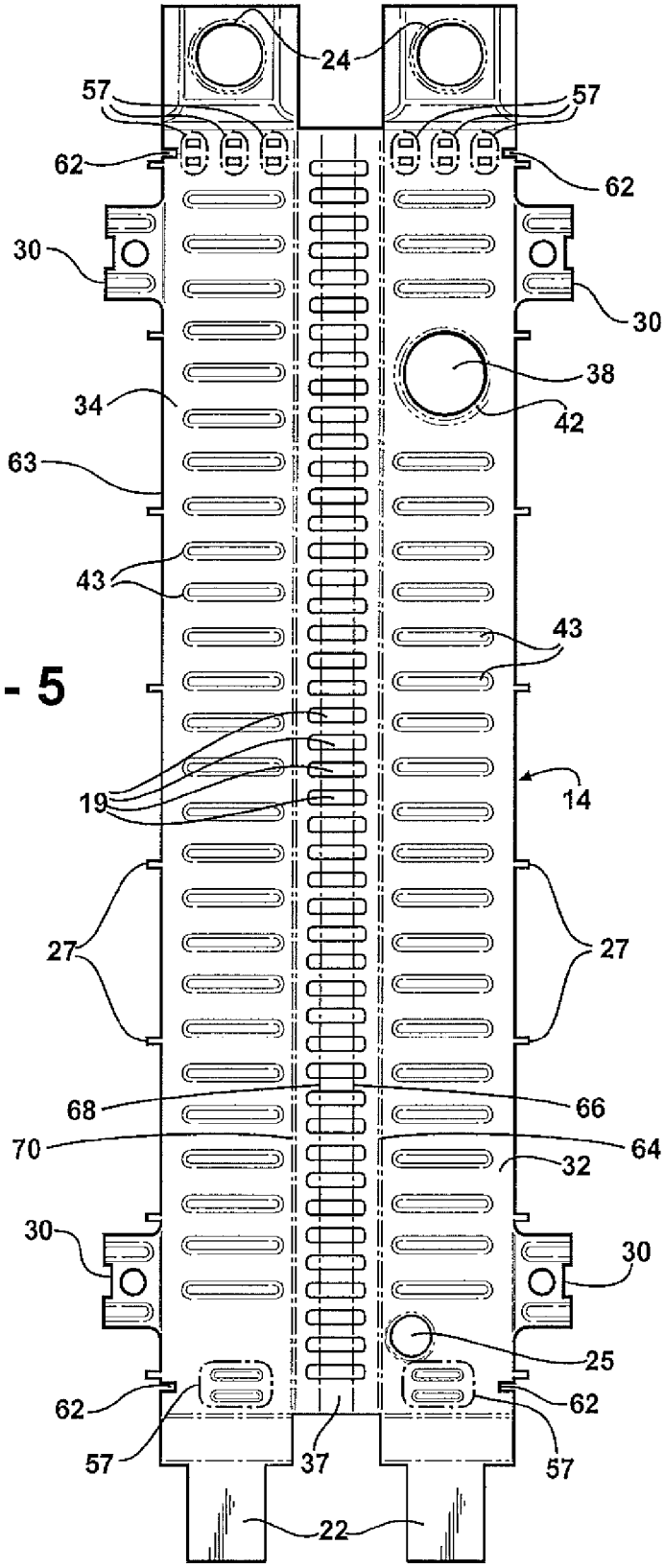
FIG. 5 is a plan view of a planar sheet for forming the tank for the heat exchanger illustrated in FIGS. 1-4.

The first tank 14 includes an inlet fitting 40 and a plurality of outlets or tube openings 19 formed therein, as more clearly shown in FIG. 5. The inlet fitting 40 includes an inlet 18 in fluid communication with a source of coolant (not shown) such as an internal combustion engine, for example. Each outlet 19 is connected to the first end of one of the tubes 12. The second end of each of the tubes 12 is connected to one of a plurality of inlets or tube openings (not shown) of the second tank 16. The first tank 14 includes a pin 22 at a first end and a bracket 24 at a second end for mounting of the heat exchanger 10 in a vehicle (not shown). It is understood that other mounting structures can be used as desired. A fluid drain 25 is provided at a bottom portion of the first tank 14 to drain fluid therefrom during system maintenance.

Figure 3:
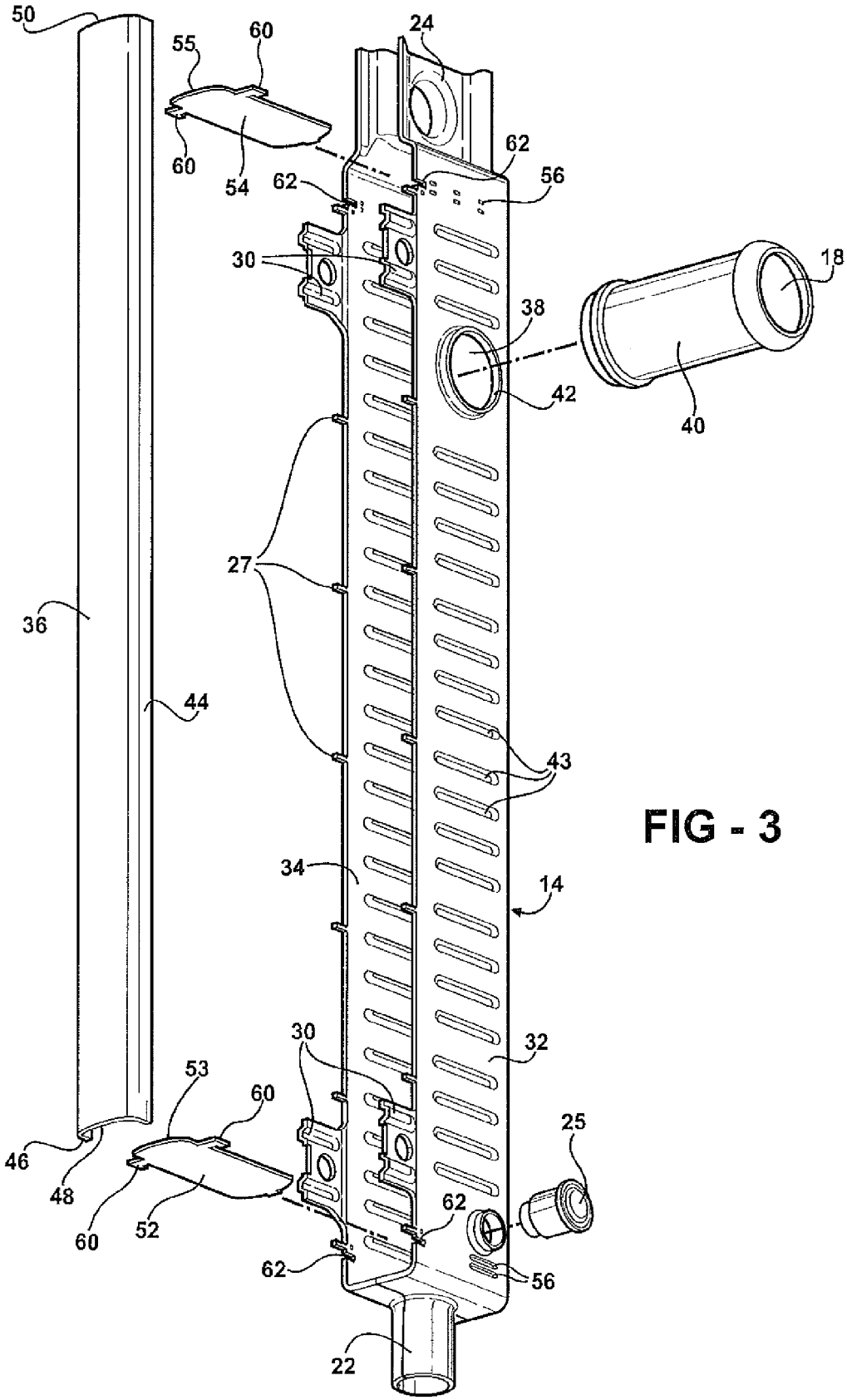
FIG. 3 is an exploded perspective view of a tank for the heat exchanger illustrated in FIGS. 1 and 2.

FIG. 3 shows an exploded view of the first tank 14. An outer wall of the first tank 14 is formed by a first sidewall 32, a second sidewall 34, an elongate cover 36, and a center wall 37, more clearly shown in FIG. 5. The first sidewall 32 includes an inlet opening 38 and a collar 42 that receive the inlet fitting 40 therein. A plurality of ribs 43 is formed in the sidewalls 32, 34 to aid in a rigidity of the first tank 14. A plurality of tabs 27 is disposed along a first end of the sidewalls 32, 34.

Figure 4:
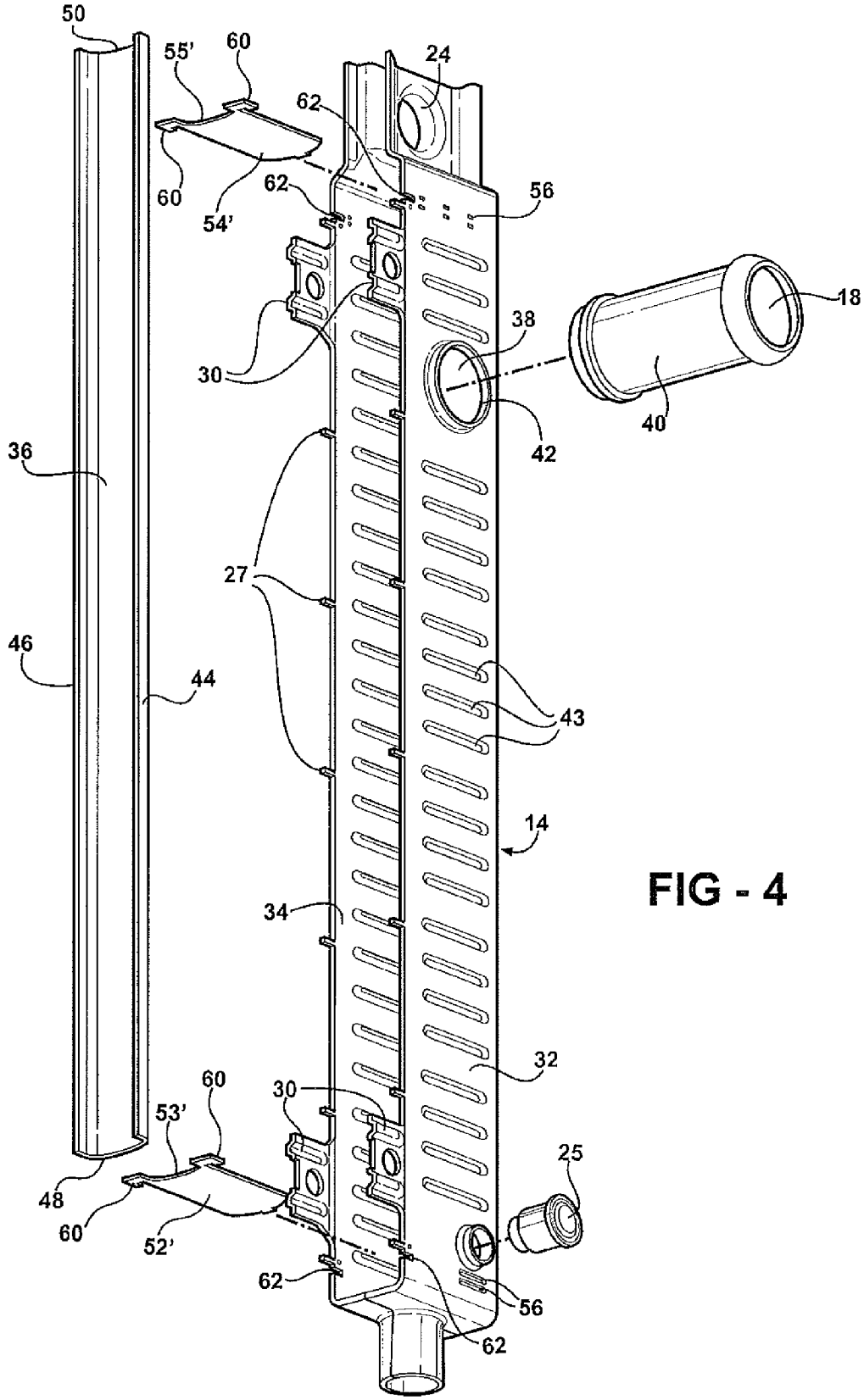
FIG. 4 is a is an exploded perspective view of a tank for a heat exchanger in accordance with another embodiment of the invention.

The cover 36 has a generally U-shaped cross section and includes a first lip 44 and a spaced apart second lip 46. The lips 44, 46 extend from a first end 48 of the cover 36 to a second end 50 of the cover 36. The lips 44, 46 are adapted to be brazed to respective sidewalls 32, 34 to create a fluid tight relationship along the entire length of the cover 36. It is understood that other methods of joining the sidowalls 32, 34 can be used such as welding, for example. The lips 44, 46 can be brazed to the sidewalls with the cover 36 face up as shown in FIG. 3 or face down as shown in FIG. 4 depending on a desired volume of the first tank 14.

A first baffle 52 and a second baffle 54 are respectively disposed at a first end and a second end of the first tank 14 between the first sidewall 32 and the second sidewall 34. The first end 48 of the cover 36 is adapted to receive an upper wall 53 of the first baffle 52. The first baffle 52 is sealingly connected to the first sidewall 32, the second sidewall 34, the center wall 37, and the first end 48 of the cover 36 to maintain a fluid tight relationship therebetween and to provide a closure to the first end of the first tank 14. The second end 50 of the cover 36 is adapted to receive an upper wall 55 of the second baffle 54. The second baffle is sealingly connected to the first sidewall 32, the second sidewall 34, the center wall 37, and the second end 50 of the cover 36 to maintain a fluid tight relationship therebetween and to provide a closure to the second end of the first tank 14. It is understood that if the desired orientation of the cover 36 is that shown in FIG. 4, a baffle 52' including an upper wall 53' and a baffle 54' including an upper wall 55' are used in place of baffles 52, 54 to sealingly engage the cover 36.

A plurality of indentations 56 is formed in an outer surface of the sidewalls 32, 34 of the first tank 14. As illustrated in FIG. 5, the indentations 56 form pairs of protuberances 57 extending outwardly from an inner surface of the sidewalls 32, 34. Each of the pairs of protuberances 57 receives one of the baffles 52, 54 therebetween to militate against relative movement between the baffles 52, 54 and the first tank 14. The baffles 52, 54 include a pair of spaced apart tabs 60 that are received by respective slots 62 formed in the sidewalls 32, 34. The tabs 60 and the slots 62 also militate against relative movement between the baffles 52, 54 and the first tank 14.

As shown in FIGS. 1 and 2, the second tank 16 includes a receiver device 26 adapted to receive a pin (not shown) formed at a first end and a bracket 28 formed at a second end for mounting the heat exchanger 10 in the vehicle (not shown). The second tank 16 includes an outlet fitting 61 formed thereon. The outlet fitting 61 includes an outlet 21 in fluid communication with the source of coolant to provide an exit for a coolant. A degassing outlet 29 is formed in the second tank 16 and is adapted to communicate with the atmosphere to facilitate a degassing of the heat exchanger 10. A plurality of inlets or tube openings (not shown) is formed in a center wall thereof, similar to that which was described above for the first tank, 14.

A method of forming the first tank 14 will now be discussed. FIG. 5 shows a planar sheet 63 for forming the sidewalls 32, 34, the center wall 37, the pin 22, the bracket 24, and mounting structures 30. The sheet 63 is formed from a substantially planar blank of ferrous or non-ferrous material, such as aluminum, for example. Any conventional method can be used to form the sheet 63 such as stamping, cutting, laser burning, and the like, for example. The planar sheet 63 includes a first bend line 64, a second bend line 66, a third bend line 68, and a fourth bend line 70 are illustrated. The sheet 63 is bent at the first bend line 64 to form the first sidewall 32 and at the fourth bend line 70 to create the second sidewall 34. In the embodiment shown, the second bend line 66 and the third bend line 68 are used to create the center wall 37 having a channel (not shown) formed therein. However, it is understood that bend lines 66, 68 can be omitted without departing from the scope of the invention.

The baffles 52, 54 are inserted between the pairs of protuberances 57 and the tabs 60 of the baffles 52, 54 are inserted into respective slots 62. The cover 36 is disposed on the first tank 14 so that the first edge 44 of the cover 36 abuts the first sidewall 32 and the second edge 46 of the cover 36 abuts the second sidewall 34. The tabs 27 are then caused to be bent inwardly to abut the cover 36 and militate against relative movement between the cover 36 and the first tank 14. The sidewalls 32, 34, the center wall 37, the cover 36, and the baffles 52, 54 are then brazed together to form a fluid tight seal. The same method of forming the tank 14 described for the embodiment in FIG. 3 is used for the embodiment shown in FIG. 4. Tubes 12 are inserted into outlets 19 of the first tank 14 and into inlets (not shown) of the second tank 16 to provide fluid communication between the first tank 14 and the second tank 16.

The second tank 16 is formed substantially the same as described above for the first tank 14. For the second tank 16, the receiver 26 and the bracket 28 replace the pin 22 and bracket 24 of the first tank 14. Further the inlet fitting 40 included on the first tank 14 is replaced by the outlet fitting 61, the fluid outlets 19 are replaced by the fluid inlets, and the fluid drain 25 is replaced by the degassing outlet 29. The configuration of the tanks 14, 16 is clearly shown in FIGS. 1 and 2. In a U-flow type heat exchanger including a baffle for diverting flow of fluid therethrough, a tank having only a plurality of tube openings therein is used. It is understood that the method described for forming the first tank 14 can be used to form the tank for the U-flow type heat exchanger.

In use, the coolant from the source of coolant is caused to flow through the inlet 18 of the inlet fitting 40 and into the first tank 14. The coolant flows through the outlets 19 and into the tubes 12. As the coolant flows through the tubes 12, air flowing over the tubes 12 heat to be transferred from causes the coolant, as is well known in the art. The coolant then flows into the second tank 16 through the inlets and exits the second tank 16 through the outlet 21 of the outlet fitting 61.

The use of the sheet 63 to form each of the tanks 14, 16 minimizes a complexity of manufacture and assembly of the tanks 14, 16. Further, the use of the pin 22, the bracket 24, the receiver 26, and the bracket 28 for mounting the unit to the vehicle minimizes the need for secondary pins and brackets used for mounting. The use of baffles 52, 54 further minimizes manufacture and assembly complexity by eliminating the need for end caps that must be attached to the ends of the tanks 14, 16.

The use of the pairs of protuberances 57 as a guide for inserting baffles 52, 54 facilitates an alignment of the baffles 52, 54 and maintains the baffles 52, 54 in a desired position once inserted.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A heat exchanger comprising:

a first tank having an inlet and a plurality of tube openings formed therein, the inlet adapted to be in fluid communication with a source of coolant, wherein the first tank further comprises:

a first sidewall including a plurality of protuberances extending outwardly from an inner surface thereof;

a second sidewall spaced apart from the first sidewall, the second sidewall including a plurality of protuberances extending outwardly from an inner surface thereof;

a center wall formed between the sidewalls;

a cover disposed adjacent the first sidewall and the second sidewall, the cover having a first end and a spaced apart second end;

a first baffle received between the protuberances of the first sidewall and the second sidewall, wherein the first baffle sealingly engages the first sidewall, the second sidewall, the center wall, and the first end of the cover to form a fluid tight seal therebetween and provide a closure to the first tank; and a second baffle received between the protuberances of the first sidewall and the second sidewall, wherein the second baffle sealingly engages the first sidewall, the second sidewall, the center wall, and the second end of the cover to form a fluid tight seal therebetween and provide a closure to the first tank;

a second tank having a plurality of tube openings and an outlet formed therein, the outlet adapted to be in fluid communication with the source of coolant, wherein the second tank further comprises:

a first sidewall including a plurality of protuberances extending outwardly from an inner surface thereof;

a second sidewall spaced apart from the first sidewall, the second sidewall including a plurality of protuberances extending outwardly from an inner surface thereof;

a center wall formed between the sidewalls;

a cover disposed adjacent the first sidewall and the second sidewall, the cover having a first end and a spaced apart second end;

a first baffle received between the protuberances of the first sidewall and the second sidewall, wherein the first baffle sealingly engages the first sidewall, the second sidewall, the center wall, and the first end of the cover to form a fluid tight seal therebetween and provide a closure to the second tank; and a second baffle received between the protuberances of the first sidewall and the second sidewall, wherein the second baffle sealingly engages the first sidewall, the second sidewall, the center wall, and the second end of the cover to form a fluid tight seal therebetween and provide a closure to the second tank; and a plurality of tubes having a first end and a second end, wherein the first end of each of the tubes is in fluid communication with one of the tube openings of the first tank and the second end of each of the tubes is in fluid communication with one of the tube openings of the second tank.

2. The heat exchanger according to claim 1, wherein the first sidewall and the second sidewall of the first tank include a plurality of slots formed therein adapted to receive a pair of tabs formed on each of the first baffle and the second baffle of the first tank, and wherein the first sidewall and the second sidewall of the second tank include a plurality of slots formed therein adapted to receive a pair of tabs formed on each of the first baffle and the second baffle of the second tank.

3. The heat exchanger according to claim 1, wherein the first sidewall of the first tank cooperates with the second sidewall of the first tank to form at least one of a pin and a bracket for mounting the heat exchanger, and wherein the first sidewall of the second tank cooperates with the second sidewall of the second tank to form at least one of a pin and a bracket for mounting the heat exchanger.

4. A heat exchanger comprising:

a tank having at least one tube opening formed therein, wherein the tank is in fluid communication with a source of coolant, and wherein the tank further comprises:

a plurality of walls, wherein at least one of the walls includes a plurality of protuberances extending outwardly from an inner surface thereof;

at least one baffle received between the protuberances; and a cover disposed adjacent at least one of the walls, wherein the cover, at least one of the walls, and the at least one baffle are joined to form a fluid tight seal therebetween and provide a closure to the tank; and a tube in fluid communication with the at least one tube opening of the tank, wherein a coolant flows through the at least one tube opening of the tank and the tube to facilitate one of a transfer of heat to the coolant and a transfer of heat from the coolant.

5. The heat exchanger according to claim 4, wherein the at least one baffle includes a plurality of tabs formed thereon.

6. The heat exchanger according to claim 5, wherein at least one of the walls includes a plurality of slots formed therein to receive the tabs of the at least one baffle.

7. The heat exchanger according to claim 4, wherein the cover includes a first lip and a second lip extending from a first end to a second end of the cover.

8. The heat exchanger according to claim 7, wherein the first lip of the cover is joined to one of the walls of said tank and the second lip of the cover is joined to another one of the walls of the tank.

9. The heat exchanger according to claim 4, wherein at least one of the walls includes at least a portion of at least one of a pin and a bracket integrally formed thereon for mounting the heat exchanger.

10. A heat exchanger comprising:

a first tank having at least one tube opening formed therein, wherein the first tank is in fluid communication with a source of coolant, and wherein the first tank further comprises:

a plurality of sidewalls, wherein each of the sidewalls includes a plurality of protuberances extending outwardly from an inner surface thereof;

a center wall formed between the sidewalls;

at least one baffle received between the protuberances of the sidewalls; and a cover disposed adjacent the sidewalls, wherein the cover, the sidewalls, the center wall, and the at least one baffle are joined to form a fluid tight seal therebetween and provide a closure to the first tank;

a second tank having at least one tube opening formed therein, wherein the second tank is in fluid communication with a source of coolant, and wherein the second tank further comprises:

a plurality of sidewalls, wherein each of the sidewalls includes a plurality of protuberances extending outwardly from an inner surface thereof;

a center wall formed between the sidewalls;

at least one baffle received between the protuberances of the sidewalls; and a cover disposed adjacent the sidewalls, wherein the cover, the sidewalls, the center wall, and the at least one baffle are joined to form a fluid tight seal therebetween and provide a closure to the second tank;

a tube in fluid communication with the at least one tube opening of the first tank and the at least one tube opening of the second tank, wherein a coolant flows through the at least one tube opening of the tanks and the tube to facilitate one of a transfer of heat to the coolant and a transfer of heat from the coolant.

11. The heat exchanger according to claim 10, wherein the at least one baffle of the first tank includes a plurality of tabs formed thereon.

12. The heat exchanger according to claim 11, wherein each of the sidewalls of the first tank includes at least one slot formed therein to receive the tabs of the at least one baffle.

13. The heat exchanger according to claim 10, wherein the cover of the first tank includes a first lip and a second lip extending from a first end to a second end of the cover.

14. The heat exchanger according to claim 13, wherein the first lip of the cover of the first tank is joined to one of the sidewalls of the first tank and the second lip of the cover of the first tank is joined to another one of the sidewalls of the first tank.

15. The heat exchanger according to claim 10, wherein each of the sidewalls of the first tank includes at least a portion of at least one of a pin and a bracket integrally formed thereon for mounting the heat exchanger.

16. The heat exchanger according to claim 10, wherein the at least one baffle of the second tank includes a plurality of tabs formed thereon.

17. The heat exchanger according to claim 16, wherein each of the sidewalls of the second tank includes at least one slot formed therein to receive the tabs of the at least one baffle.

18. The heat exchanger according to claim 10, wherein the cover of the second tank includes a first lip and a second lip extending from a first end to a second end of the cover.

19. The heat exchanger according to claim 18, wherein the first lip of the cover of the second tank is joined to one of the sidewalls of the second tank and the second lip of the cover of the second tank is joined to another one of the sidewalls of the second tank.

20. The heat exchanger according to claim 10, wherein the sidewalls of the second tank includes at least a portion of at least one of a pin and a bracket integrally formed thereon for mounting the heat exchanger.

* * * * *